US005310398A

United States Patent [19]

Yoneyama

[11] Patent Number: 5,310,398

[45] Date of Patent: May 10, 1994

[54] METHOD AND APPARATUS FOR FOLDING AND INTERFOLDING SINGLE-PLY WEBS

[76] Inventor: Katsu Yoneyama, 413 Mitojima, Fuji-shi, Shizuoka-ken, Japan

[21] Appl. No.: 969,366

[22] Filed: Oct. 30, 1992

[30] Foreign Application Priority Data

Nov. 1, 1991 [JP] Japan ..... 3-315461

[51] Int. Cl.[5] ..... B65H 35/08; B65H 37/06; B65H 45/20

[52] U.S. Cl. ..... 493/430; 493/433; 270/39

[58] Field of Search ..... 493/359, 430, 433; 270/39

[56] References Cited

U.S. PATENT DOCUMENTS

| | | | |
|---|---|---|---|
| 3,489,406 | 1/1970 | Nystrand | 493/430 |
| 4,279,411 | 7/1981 | Nystrand | 493/433 |
| 4,778,441 | 10/1988 | Couturier | 493/433 |
| 5,147,273 | 9/1992 | Rottmann | 493/430 |

*Primary Examiner*—Jack Lavinder
*Attorney, Agent, or Firm*—Wenderoth, Lind & Ponack

[57] ABSTRACT

A method and an apparatus for folding and interfolding single-ply webs, in which single-ply webs are first-folded alternately on their respective lines, tail portions and head portions of the webs are overlapped alternately while reducing the feeding distance of the webs which are already first-folded on their respective lines, and the overlapped webs are second-folded alternately.

3 Claims, 6 Drawing Sheets

METHOD AND APPARATUS FOR FOLDING AND INTERFOLDING SINGLE-PLY WEBS

BACKGROUND OF THE INVENTION

1. Field of the Invention

This invention relates to a method and an apparatus for producing wiping webs such as, for example, paper towels or paper tissues which are stored in a container in such a manner as to be able to be taken out consecutively, and particularly to single-ply webs which can be properly taken out of a container.

2. Brief Description of the Prior Art

In conventional paper towels often located at toilet rooms for daily household use such as shown in FIG. 4A, each stack of thick web segments 1 (which are folded in such a manner as head portions a and tail portions b face to face closely or touch each other) are stored in a container. The stack of folded web segments are applied pressure by a spring mechanism 2 so that the head portion a or tail portion b of the web segment 1 at the bottom is pressed against a dispensing port 3 and taken out of the container one by one.

On the other hand, in conventional paper tissues such as shown in FIG. 4B, cut and interfolded thin web segments 1 are piled up and stored in a container, and either of the two end portions b of the web segments is served as a dispensing flap. When an end portion b of the top web segment 1 is pulled out of the container through a dispensing port 3, a subsequent end portion b sticks out of the container one by one.

In the case of the conventional paper-towel serving methods as shown in FIG. 4, each paper towel cannot be taken out very easily one by one, because each dispensing flap a or b does not automatically stick out of the dispensing port one by one. Even if the dispensing port 3 is situated at the bottom of the container so that the dispensing flap a or b can, hopefully, stick out of the dispensing port by its own weight one by one, the dispensing flaps do not always sufficiently stick out of the port as expected. Also, the dispensing flap of FIG. 4A tends to be torn when the end portion b of the web 1 is pinched by fingers and pulled out with a jerk.

One way to hopefully elude this problem is to fold each web segment once and then alternately interfold each flap of the folded web segments as shown in FIG. 4B. The problem (tear of web), however, cannot be entirely eliminated in this case either, although the problem is somewhat eluted when two-ply webs are used for the material sheet. However, in the case of the paper towels, where single-ply webs are folded once but not interfolded, the problem of tear of web cannot be eluted by the method of FIG. 4B. In the case of the paper tissues where a single-ply thin paper is used for the material paper, it is more difficult to employ the method of FIG. 4B.

Thus, it has been desired that an innovative and commercially practicable method and apparatus for converting sheet materials in such a way as shown in FIG. 4C be contrived as an improvement of the conventional paper conversion technologies.

After repeated studies and trials, this inventor has finally succeeded in developing such an innovative and commercially practicable method and apparatus as described hereunder.

DISCLOSURE OF THE INVENTION

In the webs 1 shown in FIG. 4C, a single-ply web is served as a unit for taking out. This single-ply web is folded twice, and a folded tail portion of an upper web and a folded head portion of a lower web are interposed between the folded segments of the respective webs, so that the webs can be continuously taken out. In this double-folded structure, a single-ply web can be served as a unit for taking out, and therefore, this can be advantageously applied to the above-mentioned paper towels, or the like. Further, since the folded head portions of the respective webs can always be served as dispensing flaps, the problem of tear of the webs as in the case of FIGS. 4A and 4B where the folded tail portions are serves as dispensing flaps. Another advantage of this method is that stacks of web segments with large surface area can be stored in comparatively small containers.

From one aspect of the present invention, there is provided a method of folding and interfolding single-ply webs comprising a process of performing first-folding of single-ply web segments, which are formed on different lines from each other, on respective lines; a process of reducing the web feeding distance (on each line) augmented as a result of the first folding process; a process of overlapping head portions of first-folded webs on one line with tail portions of first-folded webs on another line, and second-folding overlapped first-folded webs on another line toward the overlapping surface side between tail portions of first-folded webs on one line and head portions of first-folded webs on another line backwardly adjacent thereto; and a process of overlapping tail portions of second- folded webs on another line with head portions of subsequent first-folded webs on one line, and second-folding the overlapped first-folded webs on one line toward the overlapping surface side between tail portions of second-folded webs on another line and head portions of first-folded webs on another line backwardly adjacent thereto.

From another aspect of the invention, there is also provided a n apparatus for folding and interfolding single-ply webs comprising two sets of means to cross cut two single-ply web strips on different lines to a certain length on their respective lines; two sets of means to first-fold the single-ply webs already cut to a certain length on different lines, alternately on their respective lines; a means for reducing an aligning distance of first-folded single-ply webs on one line and an aligning distance of first-folded single ply webs on another line and overlapping both the webs alternately on single surface side on one line; and a means for second-folding the overlapped webs on one line with the webs on another line alternately toward the overlapped webs side on a line along the folding tails of the respective webs.

With the above-mentioned construction of the present invention, a sequential and harmonious combination of respective processes for separately forming webs first-folded on one line and webs first-folded on another line, for mutually overlapping them while reducing the distance of the respective alignments of the webs on one line and the webs on another line, and for second-folding the both webs on one line and another line in the respective positions during the short intervals between each overlapping step, enables to obtain a folded and interfolded webs as shown in FIG. 4C.

DESCRIPTION OF THE PREFERRED EMBODIMENT

One embodiment of the present invention will now be described with reference to FIGS. 1 through 3 inclusive.

Figure 1A:
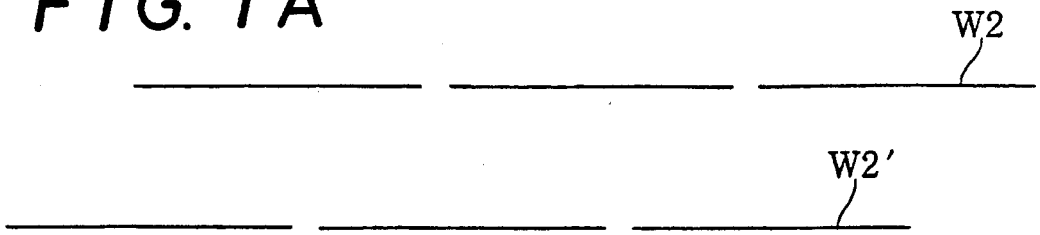
FIGS. 1A through 1F are side views showing configurations of web segments in each of the four processes: material-sheet cutting and first-folding process, feeding distance reduction process, overlapping process, and second-folding process (interfolding) process—in this order.
Figure 2:
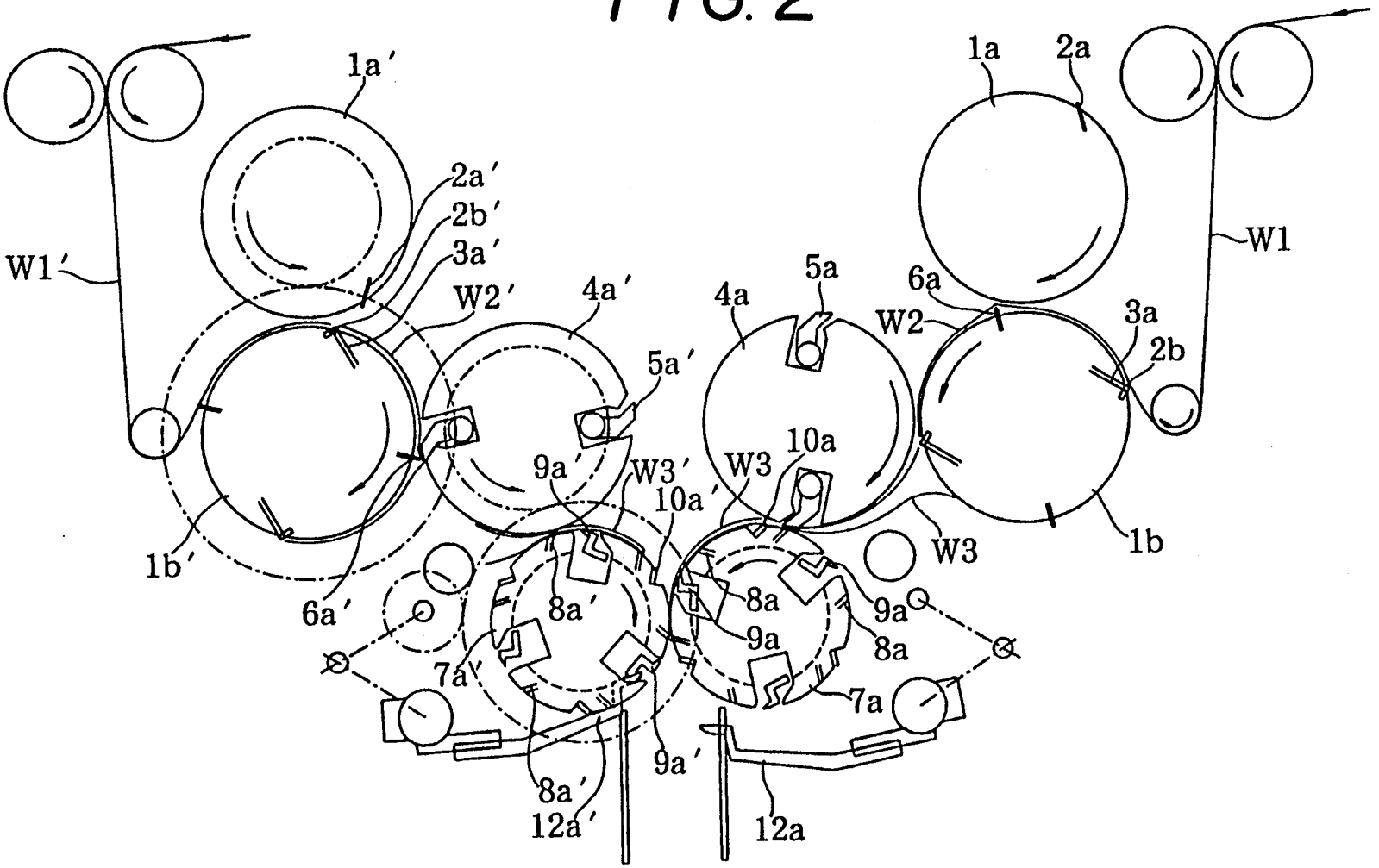
FIG. 2 is a side view showing the approximate structure of the material-sheet folding and interfolding apparatus of this invention.

As shown in FIG. 2, the apparatus includes two sets of cutting means comprising a pair of No. 1 cutting rolls 1*a* and 1*b*, and another pair of No. 2 cutting rolls 1*a*' and 1*b*' which are symmetrically situated at the upper left and upper right thereof. The No. 1 cutting rolls 1*a* and 1*b* are equipped with a pair of cutting blades 2*a* and 2*b*, while the No. 2 cutting rolls 1*a*' and 1*b*' are with a pair of cutting blades 2*a*' and 2*b*', respectively. At each prescribed rotational angle, these cutting blades cut No. 1 and No. 2 web strips W1 and W1', which are separately fed between the No. 1 cutting rolls 1*a* and 1*b*, and between the No. 2 cutting rolls 1*a*' and 1*b*', to a predetermined length. Thus, No. 1 single-ply web segment W2 and No. 2 single-ply web W2' as shown in FIG. 1A are formed on each line.

Web cutting timings of the No. 1 cutting rolls 1*a* and 1*b* and No. 2 cutting rolls 1*a*' and 1*b*' are set to be different from each other so that web segments W2 and W2' are sent to the subsequent process with a certain amount of positional difference roughly corresponding to a half the length of the web segments (FIG. 1A).

The lower cutting rolls 1*b* and 1*b*' have suction ports 3*a* and 3*a*' respectively so that leading edges of the web segments are caught on the roll peripheries and sent to the subsequent process.

The length of the web segments W2 and W2' are determined by the circumferential length of the lower rolls 1*b* and 1*b*' as well as the number of the cutting blades 2*b* and 2*b*' on the roll surface. In the case of FIG. 2, the cutting blades 2*b* and 2*b*' are situated at positions dividing each roll circumference into two equal portions, so that the length of the web segments W2 and W2' is approximately equal to a half the circumference of the lower rolls 1*b* and 1*b*'.

Further, No. 1 tucker roll 4*a* is situated at an inner side of the lower cutting roll 1*b* of the No. 1 cutting roll, while No. 2 tucker roll 4*a*' is situated at an inner side of the lower cutting roll 1*b*' of the No. 2 cutting roll. Both the tucker rolls 4*a* and 4*a*' are equipped with tucker claws 5*a* and 5*a*' on their periphery respectively, while the lower cutting rolls 1*b* and 1*b*' are equipped with insertion blades 6*a* and 6*a*', respectively.

The tucker claws 5*a* and 5*a*' and the insertion blades 6*a* and 6*a*' engage with each other at every prescribed rotational angle, and the insertion blades push approximately middle portions of the web segments W2 and W2' into the mouths of the tucker claws 5*a* and 5*a*'. The first folding process is performed in this way.

In FIG. 2, the insertion blades 6*a* and 6*a*' are situated at positions dividing the circumferential length of the rolls 1*n* and 1*b*' respectively into two equal portions and equidistance to the cutting blades 2*b* and 2*b*' (that is, positions dividing the circumference of the rolls 1*b* and 1*b*' respectively into two equal portions. In other words, the insertion blades 6*a* and 6*a*' and the cutting blades 2*b* and 2*b*' are diagonally (at an equal angle of 90 degrees) situated with each other. Thus, the insertion blades 6*a* and 6*a*' push the No. 1 and No. 2 web segments W2 and W2' at positions where the web segments (which are already cut or about to be cut by the cutting blades 1*b* and 1*b*') are divided into approximately two equal portions into the tucker claws 5*a* in order to perform a first-folding with respect to the web segments.

In this way, the lower cutting rolls 1*b* and 1*b*' act also as web-insertion webs, and each pair of the lower cutting roll 1*b* plus the tucker roll 4*a* and the lower cutting roll 1*b*' plus the tucker roll 4*a*' forms an independent first-folding means for the web-segments W2 and W2'. The No. 1 and No. 2 single-ply web segments W2 and W2' are first-folded by separate each pair of first-folding means, respectively.

Figure 1B:
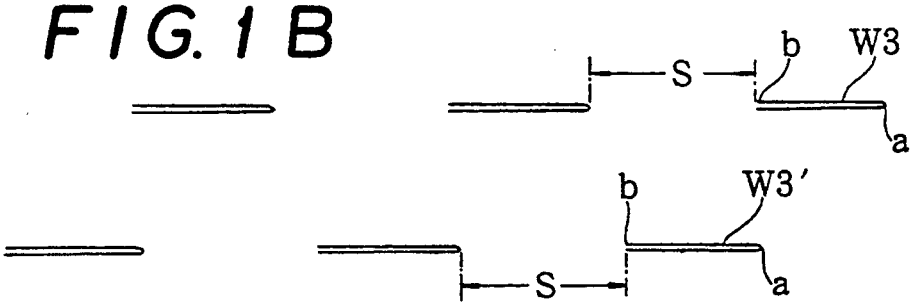

FIG. 1B shows the state of alignment of No. 1 and No. 2 first-folded web segments W3 and W3'. As shown clearly in the figure, as a result of the first-folding process, the distance between each first-folded web-segment on each line is augmented by approximately a half the web segment length.

The relative positions (and functional timings) of the blades 2*b* and 2*b*' are set to be slightly different from each other. This relation also applies to the relation between the functional timings of the tucker claws 5*a* and 5*a*' as well as the functional timings of the blades 6*a* and 6*a*'. Thus, the web segments W3 and W3' on the two lines are sent to the subsequent process, keeping a distance of S between each web on the two lines and a timing difference nearly equivalent to the web segment length between the two lines.

Figure 3A:
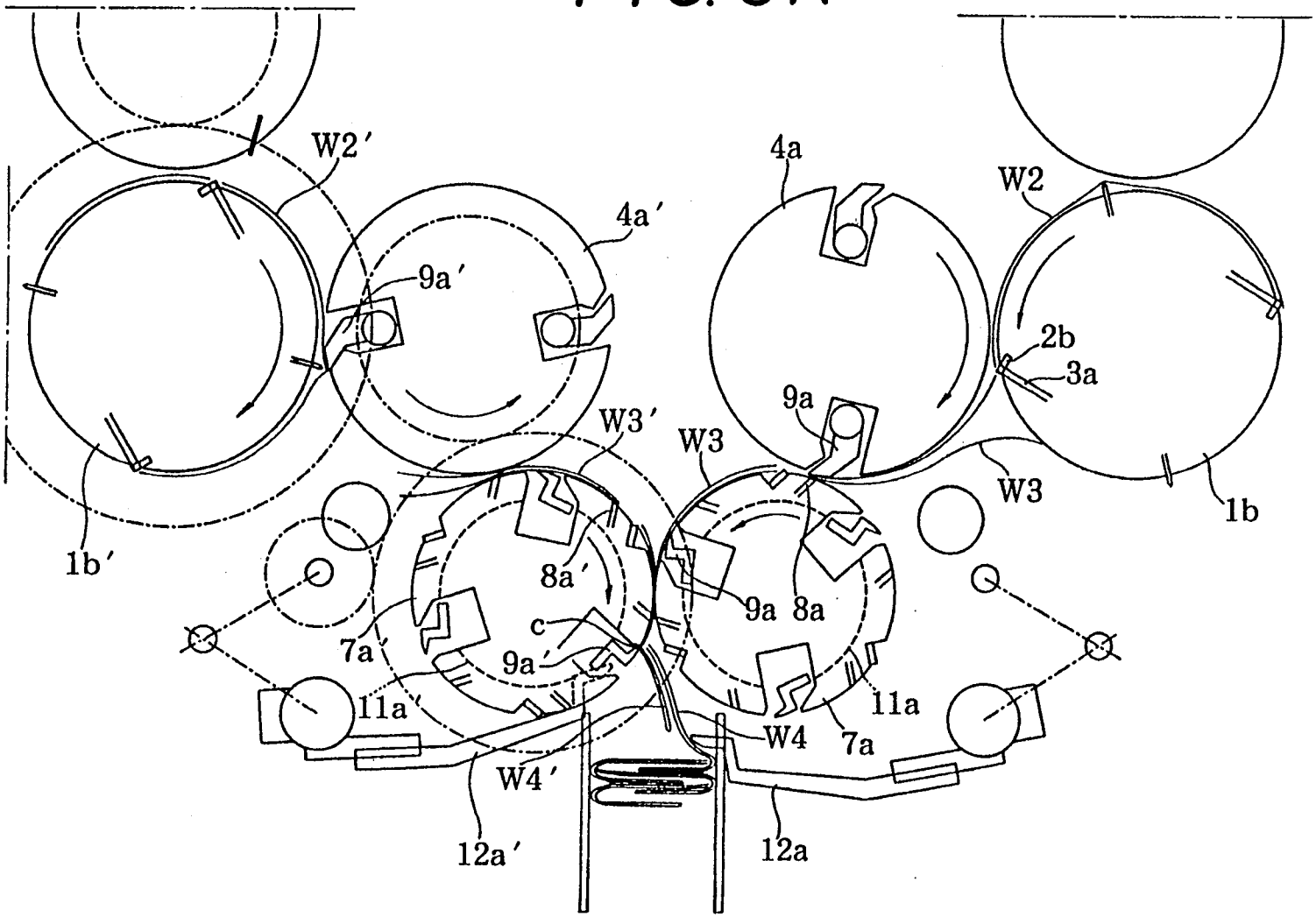
FIGS. 3A through 3C are side views illustrating the details of the folding and interfolding process done by the material-sheet folding and interfolding apparatus.

As shown in FIGS. 2, 3A, 3B and 3C, a pair of second-folding rolls 7*a* and 7*a*' is situated below the tucker rolls 4*a* and 4*a*'. The first-folded web segments W3 and W3' are tucked by the tucker claws 5*a* and 5*a*' and transferred from the rolls 1*b* and 1*b*' to the rolls 4*a* and 4*a*' respectively. Sticking around the surface of the rolls 4*a* and 4*a*', the first-folded web segments W3 and W3' are then transferred onto the surface of the second-folding rolls 7*a* and 7*a*'. FIG. 2 and 3A show the state where the No. 1 first-folded web segment W3 is transferred from the vicinity of the bottom of the tucker roll 4*a* to the vicinity of the top of the second-folding roll 7*a*. The No. 2 first-folded web segment W3' is also transferred from the roll 4*a*' to the roll 7*a*' in just the same way but, as stated a little earlier, with a certain amount of timing difference from the case of the web segments W3.

More specifically, the tucker claws 5*a* and 5*a*' begin to catch the web segments W3 and W3' at the side edges of the rolls 4*a* and 4*a*' respectively, and carry them to the vicinities of the bottoms of the rolls where the claws 5a and 5a' release the web segments W3 and W3', and press a head portion a of the web segments against the peripheries of the second-folding rolls 7a and 7a' at the vicinities of the tops of 7a and 7a' in order to stick the web segments W3 and W3' around the rolls 7a and 7a' alternately.

The No. 1 and No. 2 second-folding rolls 7a and 7a' are equipped with suction ports 8a and 8a' adapted to receive the web segments W3 and W3' from the rolls 4a and 4a'. The web segments W3 and W3' are sucked head portions a thereof alternately by the suction ports 8a and 8a' and transferred along the peripheral surfaces of the rolls 7a and 7a' to the side edges of the rolls 7a and 7a' (i.e., between the opposing surfaces of the rolls 7a and 7a'), and further to the vicinities of the bottoms of the rolls 7a and 7a' in order to overlap the web segments W3 and W3' as will be described afterward.

Figure 1C:
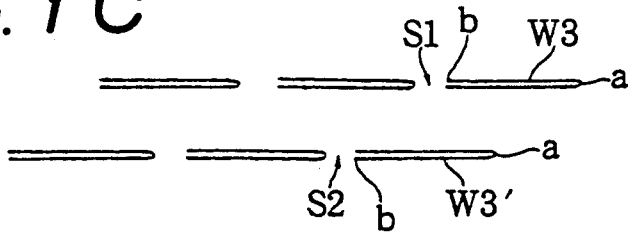

As explained earlier with reference to FIG. 1B, the distance between each web segment on each line is augmented by the first-folding process. The distance thus augmented must be diminished so that the web segments W3 and W3' can be overlapped later on. This invention includes a process where the augmented distance S between each web segment on two lines can be diminished as shown in FIG. 1C. To be more specific, the peripheral rotational speeds of the second-folding rolls 7a and 7a' are set to be sufficiently lower than those of the tucker rolls 4a and 4a', and suction ports 8a and 8a' are positioned with a mutual distance equal to the length of the web segment W3 or W3' plus distance S1 or S3. The number of the suction ports 8a and 8a' are set to be larger than that of the trucker claws 5a and 5a' to ensure the transfer of the web segments. In FIG. 2, a set of three suction ports 8a and 8a' are situated at the locations dividing set of three equal portions, and another set of three suction portions are provided likewise.

Thus, the feeding distance between each web segments on the two lines is reduced when each segment is transferred from the rolls 4 and 4a' to the suction ports 8a and 8a' of the rolls 7a and 7a'. The degree of reduction corresponds to the difference in the peripheral rotational speeds of the tucker rolls 4a and 4a' and the second-folding rolls 7a and 7a'. In other words, as shown in FIG. 1C, the feeding distance enabling the overlapping activities is reduced, and then the web segments W3 and W3' are brought between the opposing surfaces of the rolls 7a and 7a'. In this way, the web segments W3 and W3' can be adequately overlapped one by one as shown in FIGS. 3A through 3C and 1D.

To further elucidate the description above, the feeding distance between the web segments W3 on two lines and the feeding distance between the web segments W3' are reduced as shown in FIG. 1C, and the mutual positions of the web segments W3 and W3' are set to be slightly different from each other as shown in said figure and introduced between the rolls 7a and 7a'. Thus, as shown in FIGS. 1D, 3A, 3B and 3C, the tail portion b of the web segment W3 and the head portion a of the web segment W3' are overlapped. Then, the tail portion b of the web segment W3' and the head portion a of a subsequent web segment W3 are overlapped. In this way, the web segments are overlapped one by one.

This invention further includes a second web-folding process, which is done during the short intervals between each overlapping step described above. To be more specific, a plurality of tucker claws 9a and 9a' are provided on the circumferential surface of the rolls 7a and 7a' at positions dividing the circumference into several equal portions. In FIG. 2, three tucker claws 9a and 9a' are provided on the peripheral surface of the rolls 7a and 7a' at positions dividing the periphery into three equal portions. Between these tucker claws are situated three insertion blades 10a and 10a' also at positions dividing the roll periphery into three equal portions. Each of the suction ports 8a and 8a' described earlier is provided between the insertion blades 10a and 10a' and the tucker claws 9a and 9a'.

Further, the relative positions of a set of components 8a, 9a, and 10a of the roll 7a and a set of components 8a', 9a', and 10a' of the roll 7a' are set to be slightly different from each other so that the second folding of the web segments W3 and W3' can be alternately done one by one. In other words, after the suction port 8a sucks the head portion a of the web segment W3, the suction port 8a' suctions the head portion a of the web section W3' alternately with a prescribed timing difference. After the tucker claw 9a of the roll 7a is engaged with the blade 10a of the other roll 7a', the tucker claw 9a of the other roll 7a' is engaged with the blade 10 of the roll 7a alternately with a prescribed timing difference.

Since the tucker claws 9a and 9a', and the blades 10a and 10a' are mutually engaged alternately, the second-folding is performed alternately as mentioned. To be more specific, as shown in FIGS. 3A, 3B, 3C and 1E, the tail portions of the web segments W3 are overlapped with the head portions of the web sections W3' at the same time when a portion c of the preceding web segments W3 is transferred to the vicinity of the bottom (through the side edge) of the roll 7a (FIG. 3C). Immediately after this overlapping step, the tucker claws 9a' of the roll 7a' and the insertion blades 10a of the roll 7a engage with each other. The insertion blades 7a press W3' along the tail edge (shown as P1 in FIG. 1D) of the preceding W3 (which is already second-folded) into the mouth of the tucker claws 9a', and W3' is second-folded toward the overlapped surface side. In other words, W3' is second-folded (interfolded) at a space S1 between the tail portion b of the preceding W3 and the head portion a of the subsequent web segment W3.

Figure 3B:
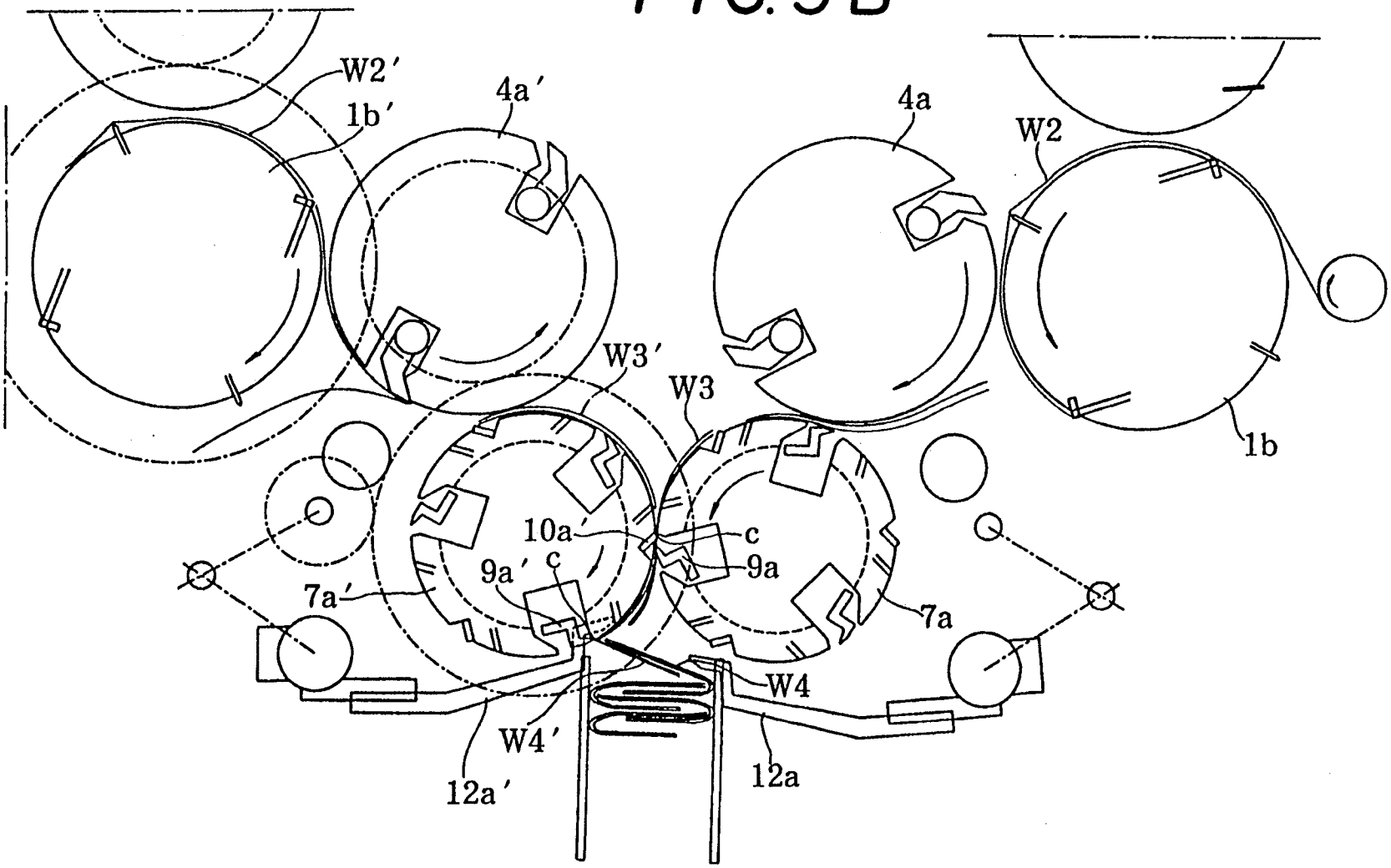
Figure 3C:
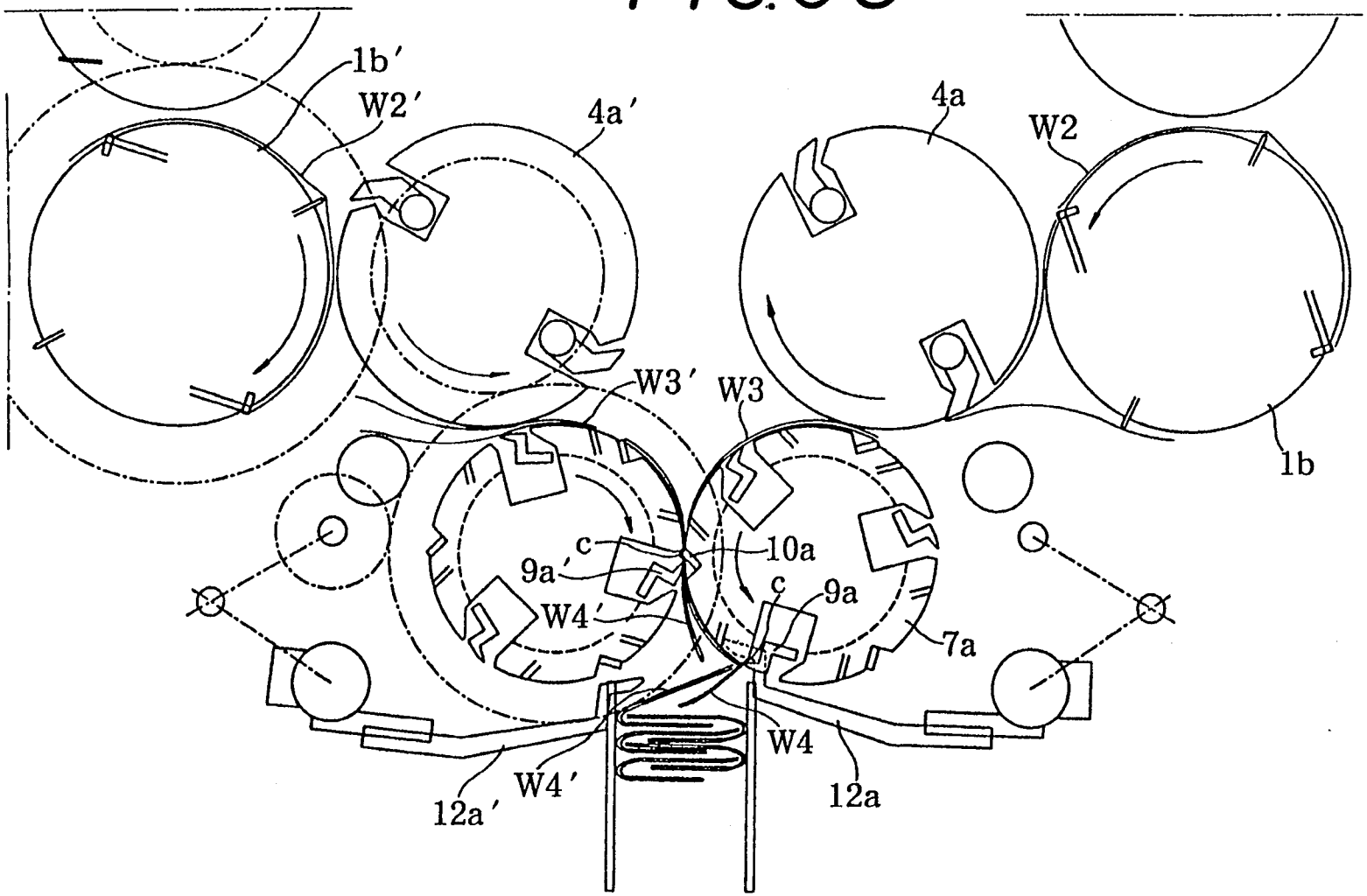

Then, as shown in FIG. 3B, the tail portion of W4' are overlapped with the head portions of the subsequent W3 at the same time when the portion c of the preceding web segments W4' is transferred to the vicinity of the bottom (through the side edge) of the roll 7a' (FIG. 3B). Immediately after this overlapping step is over, the tucker claws 9a of the roll 7a and the insertion blades 10a' of the roll 7a' engage with each other. The insertion blades 7a' press W3 along the tail edge (shown as P2 in FIG. 1D) of the preceding W3' (which is already second-folded) into the mouth of the tucker claws 9a. Thus, W3 is second-folded (interfolded) toward the overlapping surface side.

In other words, W3 is second-folded at a space S2 formed between the tail portion b of W4' and the head portion a of W3 which is backwardly adjacent thereto. W4 shows this No. 1 second-folded web.

Figure 1D:
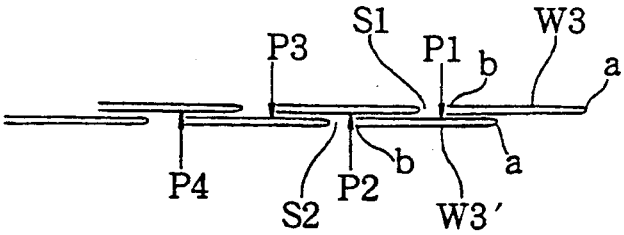

The second folding is alternately carried on at positions P3, P4, . . . likewise (FIG. 1D). Thus, No. 1 and No. 2 first-folded web segments W3 and W3' are alternately second-folded as shown in FIG. 1E. As a result of the alternate second-folding, there can be formed a folded and interfolded webs in which the tail side flap of the front W4 and the head side flap of W4 backwardly adjacent thereto is interposed between the web segments W4', and the tail side flap of the front W4' and the head side flap of W4' backwardly adjacent thereto is interposed between the web segments W4.

As shown in FIG. 2, a pair of folding bars 12*a* and 12*a*' (which move up and down) are situated below the rolls 7*a* 7*a*'. When the portion c of the web segment W4 is carried to the vicinity of the bottom of the roll 7*a* by the tucker claw 9*a* of the roll 7*a*, the first folding lever 12*a* is moved down from the state of FIG. 3C to the state of FIG. 3B in order to pressed down by the folding portion C.

Similarly, when the portion c of the web segment W4' is carried to the vicinity of the bottom of the roll 7*a*' by the tucker claw 9*a*' of the roll 7*a*', the second folding lever 12*a*' is moved down from the state of FIG. 3B to the state of FIG. 3C in order to pressed down the folding portion C. After the downward movements, the lever 12*a* and 12*a*' are raised again alternately into peripheral grooves 11*a* and 11*a*' of the rolls 7*a* and 7*a*' to standby. As a result of the alternate actions of the levers 12*a* and 12*a*', the No. 1 and No. 2 second-folded web segments W4 and W4' are piled up one by one as shown in FIG. 1E.

Figure 1F:
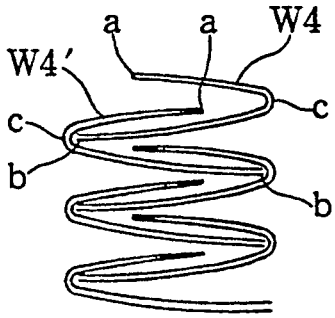
Figure 1E:
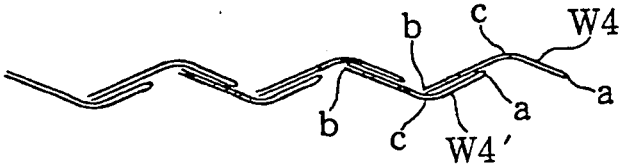
Figure 4A:
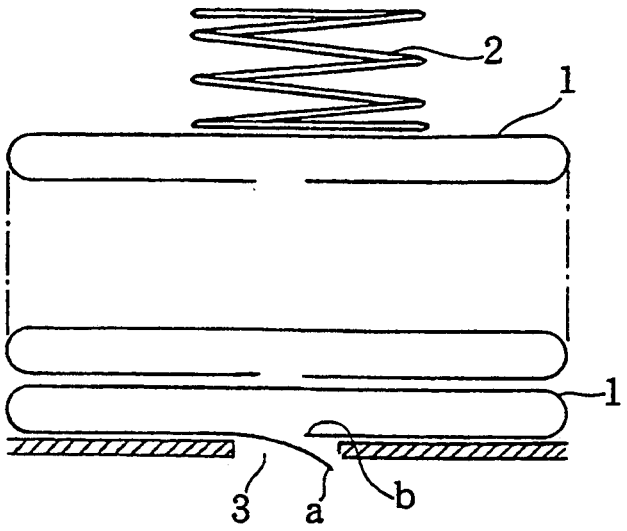
FIG. 4A PRIOR ART
FIG. 4A is a side view showing the approximate configuration of a stack of paper towels produced and stored in a container in conventional ways.
Figure 4B:
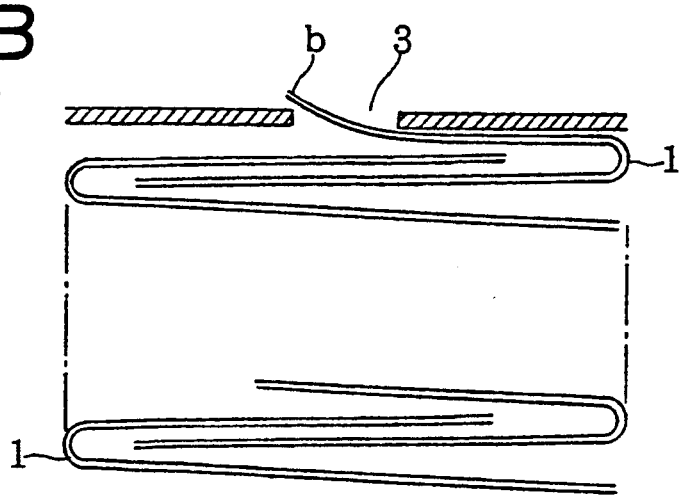
FIG. 4B PRIOR ART
FIG. 4B is a side view showing the approximate configuration of a stack of paper tissues produced and stored in a container in conventional ways.
Figure 4C:
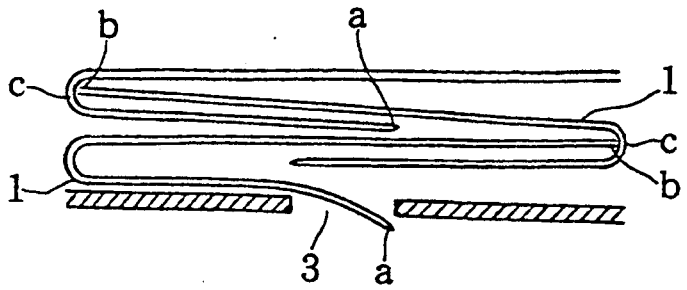
FIG. 4C is a side view showing the approximate configuration of folded and interfolded web segments produced in the say specified herein.

The processes and the means of this invention described above are combined together and work harmoniously with each other without interruption, so that, as shown in FIGS. 1F and 4C, the folded and interfolded single-ply web segments can be picked at their head portions and smoothly dispensed out of containers one by one without paper break.

The processes and the means of this invention are unique in that they can be effectively utilized, for the first time in the industry for the purposes of producing folding and interfolding webs utilizing the single-ply webs shown in FIG. 4C, in actual commercial scale operations. Thus, this invention is well applicable folded and interfolded web segments such as served as paper towels, in which single-ply web segments can be taken out continuously.

What is claimed is:

1. A method of folding and interfolding single ply webs, said method comprising the steps of:

transporting a first set of single-ply web segments along one line as spaced from one another by first distances, and transporting a second set of single-ply web segments along another line as spaced apart from one another by first distances;

while the web segments are being transported along the lines, respectively, as spaced by said first distances, folding the web segments to thereby produce No. 1 folded single-ply web segments on said one line and No. 2 folded single-ply web segments on said another line which are spaced apart from one another on each of the lines, respectively, by second distances greater than said first distances, respectively, each of the folded single-ply web segments including a head portion about which the web segment is folded and a tail portion at which respective terminal edges of the web segment lie in an overlapped state;

subsequent to said step of folding, reducing the second distances between the folded single-ply web segments while the folded single-ply web segments are transported along the lines, respectively;

overlapping the tail portions of the No. 1 folded single-ply web segments with the head portions of the No. 2 folded single-ply web segments, respectively;

overlapping the tail portions of the No. 2 folded single-ply web segments with the head portions of the No. 1 folded single-ply web segments, respectively;

said steps of overlapping being carried out in a manner in which the head portions of the No. 1 folded single-ply web segments are located to the same side of the No. 2 folded single-ply web segments as the tail portions of the No. 1 folded single-ply web segments;

with the tail portion of each preceding No. 1 folded single-ply web segment overlapped with the head portion of a No. 2 folded single-ply web segment and the tail portion of the same No. 2 folded single-ply web segments overlapped with the head portion of a succeeding No. 1 folded single-ply web segment, folding the No. 2 folded single-ply web segment at a location between the tail portion of said preceding No. 1 folded single-ply web segment and the head portion of said succeeding No. 1 folded single-ply web segment in a direction which brings the overlapping tail portion of said preceding No. 1 folded single-ply web segment and head portion of the No. 2 folded single-ply web segment back toward the overlapping tail portion of said same No. 2 folded single-ply web segment and head portion of said succeeding No. 1 folded single-ply web segment such that the tail portion of each said preceding No. 1 folded single-ply web segment and the head portion of the succeeding No. 1 folded single-ply web segment are interfolded within a No. 2 folded single-ply web segment; and with the tail portion of each preceding No. 2 folded single-ply web segment overlapped with the head portion of a No. 1 folded single-ply web segment and the tail portion of the same No.1 folded single-ply web segment overlapped with the head portion of a succeeding No. 2 folded single-ply web segment, folding said same No. 1 folded single-ply web segment at a location between the tail portion of said preceding No. 2 folded single-ply web segment and the head portion of said succeeding No. 2 folded single-ply web segment in a direction which brings the overlapping tail portion of said preceding No. 2 folded single-ply web segment and head portion of said same No. 1 folded single-ply web segment back toward the overlapping tail portion of said same No. 1 folded single-ply web segment and head portion of said succeeding No. 2 folded single-ply web segment such that the tail portion of each said preceding No. 2 folded single-ply web segment and the head portion of the succeeding No. 2 folded single-ply web segment are interfolded within a No. 1 folded single-ply web segment.

2. An apparatus for folding and interfolding single-ply webs, said apparatus comprising:

first means for cutting a single-ply web across its width to form first web segments each of a respective length;

second means for cutting another single-ply web across its width to form second web segments each of a respective length;

first folding and transporting means for folding the first web segments to form No. 1 folded single-ply web segments and for longitudinally transporting the No. 1 folded single-ply web segments as spaced apart by one another by longitudinal predetermined distances;

second folding and transporting means for folding the second web segments to produce No. 2 folded single-ply web segments and for longitudinally transporting the No. 2 folded single-ply web segments as being longitudinally spaced apart from one another;

each of the folded single-ply web segments having a head portion about which the web segment is folded and a tail portion at which respective terminal edges of the web segment lie in an overlapped state; and means for interfolding the tail portion of each preceding No. 1 folded single-ply web segment and the head portion of the No. 1 folded single-ply web segment transported successively to said preceding No. 1 folded single-ply web segment within a respective said No. 2 folded single-ply web segment and for interfolding the tail portion of each preceding No. 2 tail segment and the head portion of the No. 2 folded single-ply web segment transported successively to said preceding No. 2 folded single-ply web segment within a respective said No. 1 folded single-ply web segment.

3. An apparatus for folding and interfolding single-ply webs as claimed in claim 2, wherein each of said first and said second folding and transporting means includes a tucker roll having a rotatably driven roll body, and at least one tucker claw mounted to said roll body, and said means for interfolding includes a pair of second folding rolls, each of said second folding rolls coacting with a respective one of the tucker rolls of said first and said second folding and transporting means so as to receive the folded single-ply web segments therefrom, and each of said second folding rolls being rotatably driven at a speed less than that at which the roll bodies of the tucker rolls coacting therewith are driven.

* * * * *